US006113505A

United States Patent [19]

Boehm

[11] Patent Number: 6,113,505

[45] Date of Patent: Sep. 5, 2000

[54] WOUND GOLF BALL WITH MULTI-PLY THREAD

[75] Inventor: Herbert C. Boehm, Norwell, Mass.

[73] Assignee: Acushnet Company, Fairhaven, Mass.

[21] Appl. No.: 09/217,608

[22] Filed: Dec. 22, 1998

[51] Int. Cl.[7] ..... A63B 37/06

[52] U.S. Cl. ..... 473/357; 156/186

[58] Field of Search ..... 473/351, 354, 473/356, 357, 366; 156/186, 190

[56] References Cited

U.S. PATENT DOCUMENTS

| | | | |
|---|---|---|---|
| 709,412 | 9/1902 | Kempshall | 473/366 X |
| 737,773 | 9/1903 | Richards | 473/361 X |
| 2,149,425 | 3/1939 | Draeman | 428/374 |
| 2,152,826 | 9/1939 | Spencer | 428/365 |
| 2,203,387 | 6/1940 | James et al. | 428/370 |
| 3,949,031 | 4/1976 | Fairsbanks | 264/51 |
| 4,333,648 | 6/1982 | Aoyama | 473/604 |
| 4,783,078 | 11/1988 | Brown et al. | 473/362 |
| 4,846,910 | 7/1989 | Brown | 242/435 |
| 5,007,594 | 4/1991 | Brown | 242/435.1 |
| 5,133,509 | 7/1992 | Brown | 242/435.1 |
| 5,679,196 | 10/1997 | Wilhelm et al. | 156/167 |

*Primary Examiner*—John A. Ricci
*Attorney, Agent, or Firm*—Pennie & Edmonds LLP

[57] ABSTRACT

A wound golf ball includes a center, at least one cover layer, and at least one wound layer disposed between the center and the cover layer. At least one of the wound layers is formed of a thread composed of at least two plies of material bonded together. The first and second plies have different physical properties. The first ply is more resilient than the second ply, and the second ply is more processible than the first ply. Each ply is formed of at least about 60% synthetic rubber and less than about 40% natural rubber. The synthetic rubber is a mixture of two synthetic cis- 1,4 polyisoprene rubbers with a cis-1,4 content of at least 90%. Each ply has a different ratio of the first synthetic rubber to the second synthetic rubber, so that the plies have different physical properties.

23 Claims, 3 Drawing Sheets

WOUND GOLF BALL WITH MULTI-PLY THREAD

FIELD OF THE INVENTION

This invention relates generally to golf balls, and more particularly to wound golf balls made with an improved thread.

BACKGROUND OF THE INVENTION

Wound golf balls are the preferred ball of more advanced players due to their spin and feel characteristics. Wound balls typically have either a solid rubber or fluid-filled center around which a wound layer is formed, which results in a wound core. The wound layer is formed of thread that is stretched and wrapped about the center. The wound core is then covered with a durable cover material, such as a SURLYN® or similar material, or a softer "performance" cover, such as Balata or polyurethane.

Wound balls are generally softer and provide more spin than solid balls, which enables a skilled golfer to have more control over the ball's flight and final position. Particularly, with approach shots into the green, the high spin rate of soft covered, wound balls enables the golfer to stop the ball very near its landing position. In addition, wound balls exhibit lower compression than two piece balls, however, their higher spin rate means wound balls generally display shorter distance than hard covered solid balls. However, the advantages of wound constructions over solid ones are more related to targeting or accuracy than distance.

The United States Golf Association (USGA), the organization that sets the rules of golf in the United States, has instituted a rule that prohibits the competitive use in any USGA sanctioned event of a golf ball that can achieve an initial velocity of 76.2 meters per second (m/s), or 250 ft/s, when struck by a driver with a velocity of 39.6 m/s, i.e., 130 ft/s (referred to hereinafter as "the USGA test"). However, an allowed tolerance of 2 percent permits manufacturers to produce golf balls that achieve an initial velocity of 77.7 m/s (255 ft/s).

Players generally seek a golf ball that delivers maximum distance, which requires a high initial velocity upon impact. Therefore, in an effort to meet the demands of the marketplace, manufacturers strive to produce golf balls with initial velocities in the USGA test that approximate the USGA maximum of 77.7 m/s or 255 ft/s as closely as possible. Manufacturers try to provide these balls with a range of different properties and characteristics, such as spin, compression, and "feel."

To meet the needs of golfers with various levels of skill, golf ball manufacturers are also concerned with varying the level of the compression of the ball, which is a measurement of the deformation of a golf ball under a fixed load. A ball with a higher compression feels harder than a ball of lower compression. Wound golf balls generally have a lower compression which is preferred by better players. Whether wound or solid, all golf balls become more resilient (i.e., have higher initial velocities) as compression increases. Manufacturers of both wound and solid construction golf balls must balance the requirement of higher initial velocity from higher compression with the desire for a softer feel from lower compression.

To make wound golf balls, manufacturers use automated winding machines to stretch the threads to various degrees of elongation during the winding process without subjecting the threads to unnecessary incidents of breakage. As the elongation and the winding tension increases, the compression and initial velocity of the ball increases. Thus, a more lively wound ball is produced, which is desirable.

Referring to FIG. 1, a conventional single-ply golf ball thread 10 is shown. In general, the single-ply golf ball thread 10 is formed by mixing synthetic cis,polyisoprene rubbers, natural rubber and a curing system together, calendering this mixture into a sheet, curing the sheet, and slitting the sheet into threads.

Referring to FIG. 2, a conventional two-ply golf ball thread 20 is shown. In the case of the two-ply golf ball thread, the mixture and calendering steps are the same as in the single-ply thread. However, after the sheets are thus formed, they are calendered together, cured to bond the plies or sheets together, and slit into threads. Each ply of the thread 20 has a thickness $t_1$ and $t_2$. Generally, these thicknesses are substantially the same, and each ply also has the same physical properties.

For golf balls the thread is typically formed by a calender method rather than an extrusion method, the calendered thread has a rectangular cross-section, while extruded thread generally has a circular cross-section. Extruded thread has not been used in golf ball applications, because it has not exhibited the physical properties necessary for proper performance of golf balls. An example of an extruded thread that is not used in golf balls is disclosed in U.S. Pat. No. 5,679,196 issued to Wilhelm et al. This patent discloses a thread formed of a mixture that has more than 50% natural rubber.

There are some drawbacks to the conventional threads used in golf balls. The single-ply or each ply of the two-ply thread occasionally contains weak points. As a result, manufacturers of wound balls do not wind using the maximum tension or stretch the thread to the maximum elongation, because to do so would cause an excessive amount of breakage during winding.

In the case of the two-ply thread, when one ply breaks typically the other ply also breaks, since the plies have the same physical properties. When a thread breaks during manufacturing, if the winding machine does not lose control of the free end of the thread, the machine needs to be restarted. However, if the winding machine loses control of the free end of the thread, an operator must manually re-thread the machine and restart the operation. Both of these situations decrease production, and thus are undesirable.

The thread can also break during play due to impact of a club with the ball. These breaks can result in various consequences. The cover material is disposed between the threads adjacent the cover. When the threads adjacent the cover break, the cover material tends to hold these threads in the proper position. However, if enough threads break near the cover, a lump will be created on the outside surface of the ball, which makes the ball unplayable.

More severe problems can occur, when the threads near the center break. In a wound ball with a solid rubber center, the resilient rubber of the center is relatively soft compared to the hardness of the highly stretched threads. After a thread adjacent the center breaks, the thread can contract and cause a loss of compression and initial velocity. This results in a short shot, which is undesirable.

In a wound ball with a fluid-filled center, after a thread adjacent the center breaks, if the thread unravels and contracts due to relaxation of the tension, the thread cuts through the envelope that contains the fluid. This destroys the structural integrity of the ball and makes it unplayable.

If this type of failure happens during a shot, it can result in a short shot. It can also result in the ball deviating from its line of flight as it leaves the club, so that the ball can end up off of the fairway. Both of these consequences are undesirable. Similar problems occur, when a single-ply thread breaks.

Therefore, golf ball manufacturers are continually searching for new ways in which to provide wound golf balls that deliver the maximum performance for golfers while decreasing the occurrence of thread breaks both during manufacturing and during play. It would be advantageous to provide a wound golf ball with a higher compression, higher initial velocity, improved durability, and improved manufacturing processibility. The present invention provides such a wound golf ball.

SUMMARY OF THE INVENTION

The present invention is directed towards an improved thread for use in wound golf balls. In an effort to produce a wound ball with increased velocity and which is easier to process, the present invention includes a thread formed of at least two plies connected together, where the plies have different rubber formulations to produce plies with different physical properties. The first ply of thread has more resiliency than the second ply of thread. Thus, the first ply of thread improves the velocity of the ball and the second ply of thread improves the processibility of the thread.

In one embodiment, the first and second plies have substantially different maximum elongations. In another embodiment, the first and second plies have substantially different tensile strengths. In yet another embodiment, the thickness of the plies can be the same or different. The formulations for the plies include less than 40% natural rubber and more than about 60% of at least two synthetic rubbers. In order to provide the different physical properties, the first ply has a first ratio of the first synthetic rubber to the second synthetic rubber, and the second ply has a second ratio of the first synthetic rubber to the second synthetic rubber so that the difference between the ratios is at least about 10%. The synthetic rubbers are cis-1,4 polyisoprene rubbers that have a cis-1,4 content of at least 90%. In one embodiment, the first synthetic rubber has a cis-1,4 content of about 90% and the second synthetic rubber has a cis-1,4 content of about 99%.

According to another embodiment of the present invention, the thread includes a third ply bonded to the first two plies. The third ply of thread improves the velocity of the ball or the processibility of the thread.

The invention thus provides a novel thread composition that offers the benefit of higher ball velocity and reduced thread breakage during manufacture and play.

DETAILED DESCRIPTION OF THE PREFERRED EMBODIMENTS

Figure 3:
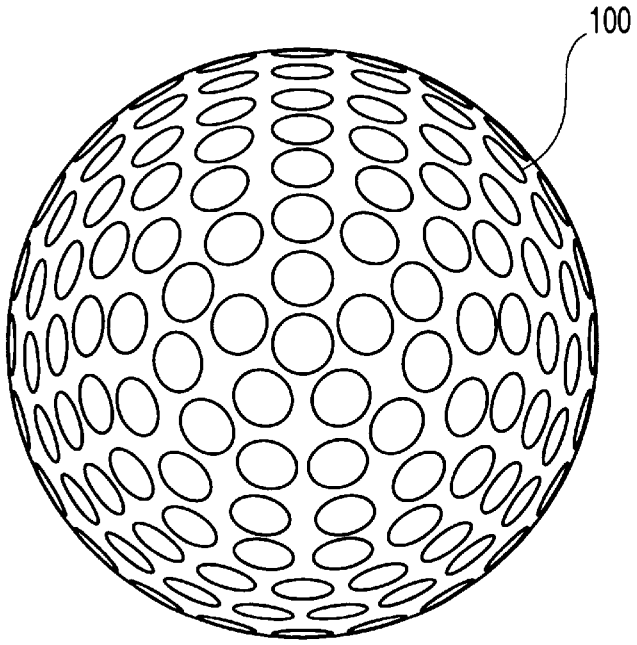
FIG. 3 is an elevational view of a golf ball according to the present invention.
Figure 4:
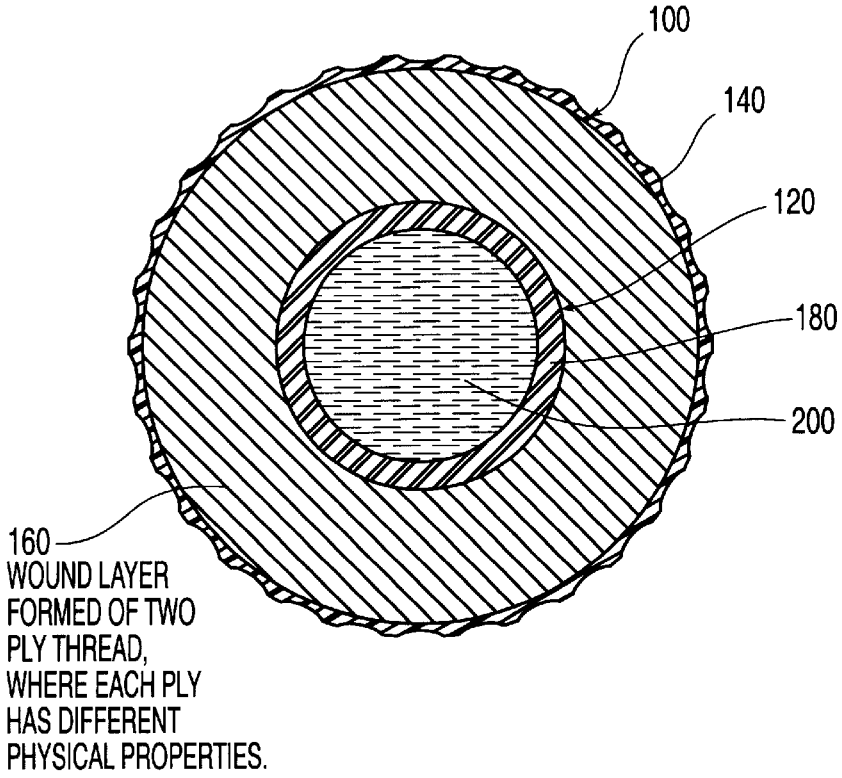
FIG. 4 is a cross-sectional view of the golf ball of FIG. 3 according to the present invention.

Referring to FIGS. 3 and 4, a wound golf ball 100 comprises a fluid-filled center 120, at least one cover layer 140 and at least one wound layer 160 disposed there between. The fluid-filled center 120 comprises a rubber or thermoplastic envelope 180 with a fluid 200 therein. In another embodiment, a conventional solid center can be used in place of the fluid-filled center. The cover 140 can be formed of material, such as balata, ionomer, metallocene, polyurethane or a combination of the foregoing. The cover 140 can have two layers where the first layer surrounds the core and the second layer surrounds the first layer.

The envelope 180 can be filled with a wide variety of materials including gas, water solutions, gels, foams, hot-melts, other fluid materials and combinations thereof. The fluid or liquid in the center can be varied to modify the performance parameters of the ball, such as the moment of inertia, weight, initial spin, and spin decay.

Suitable gases include air, nitrogen and argon. Preferably, the gas is inert. Examples of suitable liquids include either solutions such as salt in water, corn syrup, salt in water and corn syrup, glycol and water or oils. The liquid can further include water soluble or dispersable organic compounds, pastes, colloidal suspensions, such as clay, barytes, carbon black in water or other liquid, or salt in water/glycol mixtures. Examples of suitable gels include water gelatin gels, hydrogels, water/methyl cellulose gels and gels comprised of copolymer rubber based materials such a styrene-butadiene-styrene rubber and paraffinic and/or naphthionic oil. Examples of suitable melts include waxes and hot melts. Hot-melts are materials which at or about normal room temperatures are solid but at elevated temperatures become liquid.

The fluid can also be a reactive liquid system which combines to form a solid or create internal pressure within the envelope. Examples of suitable reactive liquids that form solids are silicate gels, agar gels, peroxide cured polyester resins, two part epoxy resin systems and peroxide cured liquid polybutadiene rubber compositions. Of particular interest are liquids that react to form expanding foams. It is understood by one skilled in the art that other reactive liquid systems can likewise be utilized depending on the physical properties of the envelope and the physical properties desired in the resulting finished golf balls.

Figure 1:
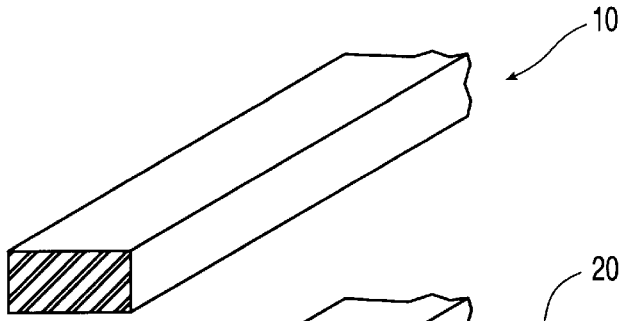
Fig. 1 Prior Art
FIG. 1 is an enlarged, partial perspective view of a conventional single-ply thread for use in a golf ball.
Figure 2:
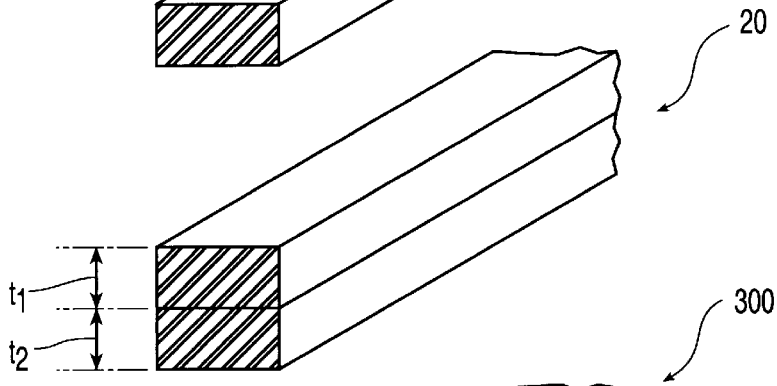
Fig. 2 Prior Art
FIG. 2 is an enlarged, partial perspective view of a conventional two-ply thread for use in a golf ball.
Figure 5:
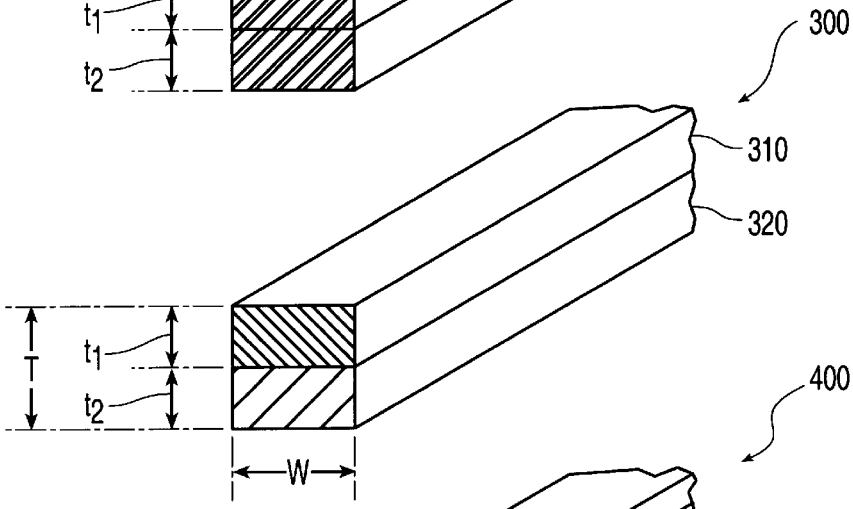
FIG. 5 is an enlarged, partial perspective view of a two-ply thread for use in the golf ball of the present invention.

Referring to FIGS. 4 and 5, the wound layer 160 is formed of an elastic thread 300 of the present invention. The thread 300 is formed of two plies 310 and 320. The thread is formed by the conventional techniques of mixing the thread materials, calendering the thread materials into sheets of the two plies, calendering the sheets or plies together, connecting the plies together, and slitting the sheets into thread 300. The step of connecting the plies together can be by vulcanizing the material while the two plies are held together under pressure, which will bond the plies together. The vulcanization system is a sulfur bearing system that is activated by heat and known by those of ordinary skill in the art. The first ply 310 is more resilient and the second ply 320 is more processible, as evidenced by the physical properties of each ply, as discussed below.

Although conventional techniques are used, the composition for each ply of the inventive thread is different, unlike conventional thread, so that each ply has different physical and mechanical properties. The mechanical properties are, for example, Bayshore Resiliency, flex modulus, and density. The thread 300 is wound about the center 120 to form the wound layer 160. This winding uses the same or various levels of tension and elongation in a conventional fashion. For example, initially the winding can occur at low tension then at a predetermined time the winding can occur at high tension.

Referring to FIG. 5, the first ply 310 and the second ply 320 are formed of at least about 60% of a blend of two synthetic cis-1,4 polyisoprene rubbers, and about less than 40% of a natural rubber. The first and second plies have a first and second ratio, respectively, of the first cis-1,4 polyisoprene rubber to the second cis-1,4 polyisoprene rubber. The first ratio is preferably different from the second ratio by at least about 10%.

It is preferred that the synthetic cis-1,4 polyisoprene rubbers have a cis-1,4 content of at least 90%, however the cis-1,4 contents may vary for each rubber. The first synthetic cis-1,4 polyisoprene rubber has a cis-1,4 content of about 90% and Cariflex IR-309, which is commercially available and manufactured by Shell Chemicals, is preferred. The first cis-1,4 polyisoprene increases the resiliency of the thread, and leads to a ball with higher initial velocity, however this type of thread has a tendency to break more easily during the winding process and is more expensive.

The preferred second synthetic cis-1,4 polyisoprene rubber has a cis-1,4 content of about 99%, and Natsyn 2200, which is commercially available and manufactured by Goodyear is preferred. The second synthetic rubber has a higher cis-1,4 content than the first synthetic rubber. The second cis-1,4 polyisoprene rubber produces a ball with lower initial velocity, however this type of thread does not have a tendency to break during the winding process, thus improving the thread winding processibility.

Figure 6:
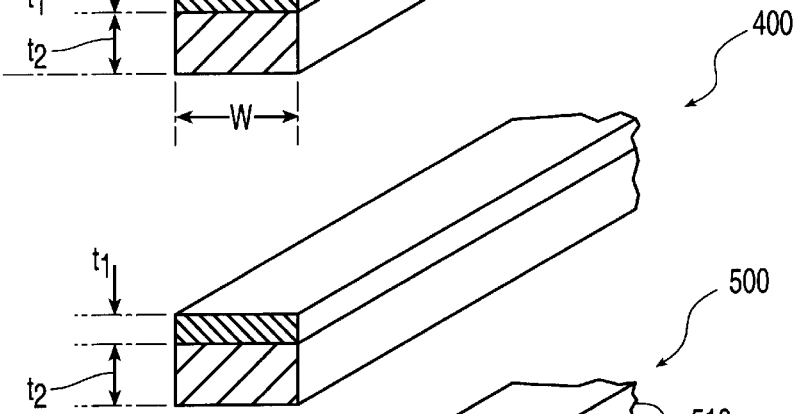
FIG. 6 is an enlarged, partial perspective view of another embodiment of the two-ply thread of the present invention.

Referring to FIGS. 4 and 5, it is preferred that the thickness T of the thread 300 that forms the wound layer 160 is between about 0.010 inches to about 0.060 inches, and more preferably between about 0.016 inches to about 0.030 inches. The width of the thread 300 is designated W, and the preferred width W is about 0.0625 inches or within the range of about 0.040 inches to about 0.080 inches. The thickness of the first ply 310 is designated $t_1$. The thickness for the second ply 320 is designated $t_2$. The thicknesses $t_1$ and $t_2$ are between about 0.005 inches to about 0.030 inches. As shown in FIG. 5, the thread 300 has ply thicknesses $t_1$ and $t_2$ that are the same. As shown in FIG. 6, another embodiment of a two-ply thread 400 has ply thicknesses $t_1$ and $t_2$ that are different. The ply 410 is more resilient than the ply 420, which is more processible. The preferred thickness of one ply with respect to the other ply depends on the performance requirements of the ball.

Figure 7:
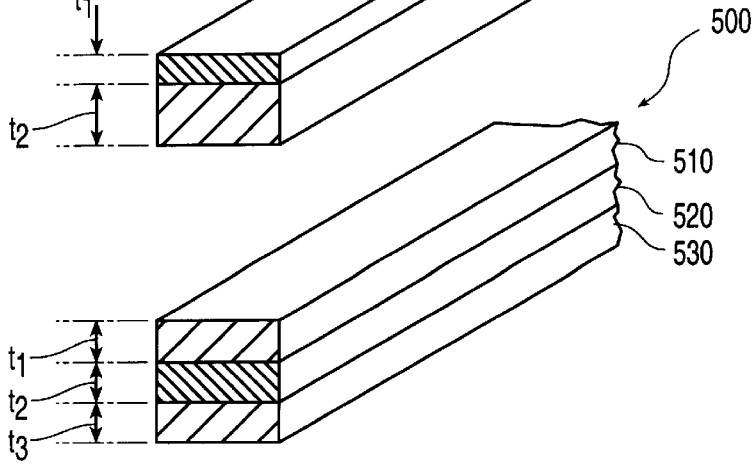
FIG. 7 is an enlarged, partial perspective view of a three-ply thread of the present invention.

Preferably at least two plies are used to form the thread 300 of the wound layer 160. However, turning to FIG. 7, a three-ply thread 500 is shown. The first ply 510, second ply 520, and third ply 530 are bonded together using the conventional calendering and curing techniques. The first and third plies 510 and 530 have the same mechanical and physical properties and composition. The second ply 520 has different mechanical and physical properties and composition. The order of the plies can be changed so that two similar layers are arranged adjacent one another. The third ply has a third ratio of the first synthetic rubber to the second synthetic rubber, as discussed above. The third ratio can be the same as or different from the ratios of either of the first or second plies. The thickness $t_3$ of the third ply 530 can be the same as one or both of the ply thicknesses $t_1$ and $t_2$ or different from both. It is preferred that the ply 520 is more resilient and plies 510 and 530 are more processible so that the more processible plies protect the resilient ply.

EXAMPLES

These and other aspects of the present invention may be more fully understood with reference to the following non-limiting examples, which are merely illustrative of the embodiments of the present invention golf ball thread, and are not to be construed as limiting the invention, the scope of which is defined by the appended claims.

The results obtained with golf balls prepared according to the examples are representative of the improved performance characteristics of golf ball thread wound centers made from the compositions of this invention.

Table I sets forth two Samples of the rubber formulation for the thread plies for use in forming the wound layer of a golf ball of the present invention.

TABLE I

Thread Ply Rubber Formulation

| Component | Sample 1 | Sample 2 |
|---|---|---|
| Cariflex (pph) | 72 | 54 |
| Natsyn (pph) | 10 | 10 |
| Natural Rubber (pph) | 18 | 36 |
| Synthetic Rubber (%) | 82 | 64 |
| C/N Ratio | 7.2 | 5.4 |

"Natural Rubber" as used above means rubber from non-man-made sources which is typically produced by drying the latex harvested from rubber trees. Both the Cariflex and the Natsyn are synthetic cis-1,4 polyisoprene rubbers. As shown above, each Sample has at least about 60% of synthetic rubber, which is Cariflex and Natsyn combined.

When forming the thread, the rubber formulations shown in Table I are mixed with a vulcanization system. The vulcanization system includes antioxidants, and any conventional vulcanization or cure system for producing golf ball thread can be used. The ratio of the vulcanization system to the rubber formulation is determined by one of ordinary skill in the art. With the above example, five parts of the vulcanization system are used for each hundred parts of the rubber formulation. The preferred vulcanization system is a sulfur bearing system as known by those of ordinary skill in the art. The components are mixed, calendered, cured and cut using conventional processes and equipment.

Table II sets forth the physical properties for various two-ply threads. All of the threads have plies of equal thickness. Thread 1 is formed with both plies being made of Sample 1 from Table I. Thread 2 is formed with both plies being made of Sample 2 from Table I. The Thread 1 is more resilient than the Thread 2, and the Thread 2 is more processible than Thread 1. Thread 3 is formed with one ply being made of Sample 1 and one ply being made of Sample 2 from Table I.

The Thread 3 has a first C/N Ratio for the first ply of 7.2 according to Table I, and a second C/N Ratio for the second ply of 5.4. The difference between the C/N Ratios is 1.8, which is more than 10%. Thus, Thread 3 is the inventive thread, and the plies of Thread 3 have different physical properties. By combining plies with different physical properties it is desired to improve the processing and performance characteristics of the thread, resulting in a golf ball with good ball velocity and durability.

TABLE II

Two-Ply Thread Physical Properties

| Physical Property | Thread 1 (Sample 1 Only) | Thread 2 (Sample 2 Only) | Thread 3 (Sample 1 & Sample 2) |
|---|---|---|---|
| Dimensions | | | |
| Thickness (in.) | 0.020 | 0.020 | 0.020 |
| Width (in.) | 0.0625 | 0.0625 | 0.0625 |
| Schwartz value (psi) | 192 | 191 | 197 |
| Modulus value (psi) | 245 | 249 | 255 |
| Factor | 1.28 | 1.30 | 1.29 |
| Tensile Strength (psi) | 7380 | 8310 | 7400 |
| Maximum Elongation (%) | 1020 | 1060 | 1020 |

The terms Schwartz value, Modulus, Factor, Tensile Strength, and Maximum Elongation as used in this specification are physical properties of the thread that are defined according to the following procedures and equations.

The thickness measurement was performed using a commercially available gauge. Several unstretched thread strands were measured for thickness near their center using the gauge. The average thickness was calculated.

The width measurement was taken near the center of several threads using a commercially available microscope. The average width was calculated.

The Modulus and Schwartz value are determined as follows. The thread is stretched holding it away from the center and placed on a hook of a commercially available Spring Dynamometer. The thread is stretched to 500% elongation and the load reading measured. This load reading is the Modulus pull value. The thread is returned to 0% elongation and stretched to 600% elongation and relaxed for five cycles. After these five cycles, the thread is again stretched to 500% elongation, the load reading is measured, and the thread is returned to 0% elongation. This load reading is the first Schwartz pull value. The thread is stretched to 600% elongation, relaxed to 500% elongation, the load reading is measured, and the thread is returned to 0% elongation. This load reading is the second Schwartz pull value.

The Schwartz value is calculated using the following equation:

$$\text{Schwartz value} = \frac{(SP)}{(2)(T)(W)}$$

where: $SP$ = average of the Schwartz pull values;
$T$ = average thickness; and
$W$ = average width.

The Modulus value is calculated using the following equation:

$$\text{Modulus value} = \frac{(MP)}{(2)(T)(W)}$$

-continued where: $MP$ = the Modulus pull value;
$T$ = average thickness; and
$W$ = average width.

The Factor is calculated using the following equation:

$$\text{Factor} = \frac{\text{Modulus value}}{\text{Schwartz value}}.$$

The Schwartz value for golf ball thread for the first and the second plies should be greater than about 175 psi. The Modulus for golf ball thread should be greater than about 225 psi. Since Thread 3 is composed of 50% of Thread 1 and 50% of Thread 2, it would be reasonable to expect the thread physical properties of Thread 3 to be about halfway between the thread physical properties of Thread 1 and Thread 2. Referring to Table II, the Schwartz value expected for Thread 3 should be about 191.5 psi and the Modulus value should be about 247 psi; however for Thread 3 the Schwartz value is 197 psi band the Modulus value is 255 psi. These values are higher than expected.

The Tensile Strength is the stress at which the thread breaks when it is stretched under certain conditions. The load at break is measured numerous times. The Tensile Strength is calculated using the following equation:

$$\text{Tensile Strength} = \frac{(LB)}{(2)(T)(W)}$$

where: $LB$ = average load at thread break;
$T$ = average thickness; and
$W$ = average width.

The Tensile Strength of threads usable for golf balls is generally greater than 5000 psi. The inventive Thread 3 has sufficient Tensile Strength, according to Table II.

The Maximum Elongation is the increase in length of the thread at break when it is stretched under the specified conditions. The Maximum Elongation is expressed as the percentage increase of the original length. The elongation at break or maximum elongation of golf ball thread is generally greater than about 800%. The inventive Thread 3 has a sufficient Maximum Elongation of 1020%, according to Table II.

Golf balls of conventional size and weight were wound and finished using the Threads 1–3 described in Table II. The balls had a fluid-filled thermoplastic center, a castable urethane cover, and were all finished together to ensure uniformity of paint coatings.

The golf balls using the three different threads were wound under four different conditions. Table III contains the physical properties measured for the balls formed using a constant thread elongation of 815%. Table IV contains the physical properties measured for the balls formed using a constant thread elongation of 835%. Table V contains the physical properties measured for the balls formed using a constant thread tension of 700 grams. Table VI contains the physical properties measured for the balls formed using a constant thread tension of 800 grams.

TABLE III

| Finished Ball Physical Properties Balls Wound With Thread Stretched To 815% Elongation | | | |
|---|---|---|---|
| Thread Type | Weight (oz) | Ball Compression (points) | Initial Velocity (ft/sec) |
| Thread 1 | 1.600 | 95 | 251.6 |
| Thread 2 | 1.598 | 92 | 249.8 |
| Thread 3 | | | |
| Actual | 1.600 | 97 | 251.3 |
| Expected | 1.599 | 93.5 | 250.7 |

TABLE IV

| Finished Ball Physical Properties Balls Wound With Thread Stretched To 835% Elongation | | | |
|---|---|---|---|
| Thread Type | Weight (oz) | Ball Compression (points) | Initial Velocity (ft/sec) |
| Thread 1 | 1.602 | 98 | 251.9 |
| Thread 2 | 1.599 | 96 | 250.3 |
| Thread 3 | | | |
| Actual | 1.602 | 103 | 251.9 |
| Expected | 1.6005 | 97 | 251.1 |

TABLE V

| Finished Ball Physical Properties Balls Wound With Thread Stretched With 700 grams Tension | | | |
|---|---|---|---|
| Thread Type | Weight (oz) | Ball Compression (points) | Initial Velocity (ft/sec) |
| Thread 1 | 1.600 | 95 | 251.6 |
| Thread 2 | 1.598 | 92 | 249.8 |
| Thread 3 | | | |
| Actual | 1.599 | 93 | 250.8 |
| Expected | 1.599 | 93.5 | 250.7 |

TABLE VI

| Finished Ball Physical Properties Balls Wound With Thread Stretched With 800 grams Tension | | | |
|---|---|---|---|
| Thread Type | Weight (oz) | Ball Compression (points) | Initial Velocity (ft/sec) |
| Thread 1 | 1.602 | 98 | 251.9 |
| Thread 2 | 1.599 | 96 | 250.3 |
| Thread 3 | | | |
| Actual | 1.600 | 97 | 251.3 |
| Expected | 1.6005 | 97 | 251.1 |

As used herein, the terms "points" or "compression points" refer to the compression scale when balls are measured using a compression tester manufactured by ATTI Engineering of New Jersey.

The initial velocity results were obtained from a standard technique, whereby the balls are struck at 39.6 m/s (130 ft/s), and pass through light gates, which measure their speed. This standard measurement technique is well-known to those of ordinary skill in the art of making golf balls.

Since Thread 3 is composed of 50% of Thread 1 and 50% of Thread 2, it would be reasonable to expect the ball physical properties of Thread 3 to be about halfway between the ball physical properties of Thread 1 and Thread 2. These expected values for Thread 3 are reported in Tables III–VI. Indeed, as shown in Tables V and VI, with the Thread 3 wound at constant tensions of 700 grams or 800 grams the expected values of compression and velocity substantially match the actual values. However, as shown in Tables III and IV, with Thread 3 wound at constant elongations of 815% or 835% the results for compression and velocity were surprising. In both cases, the compression and velocity were substantially higher than expected, which is desirable.

Figure 8:
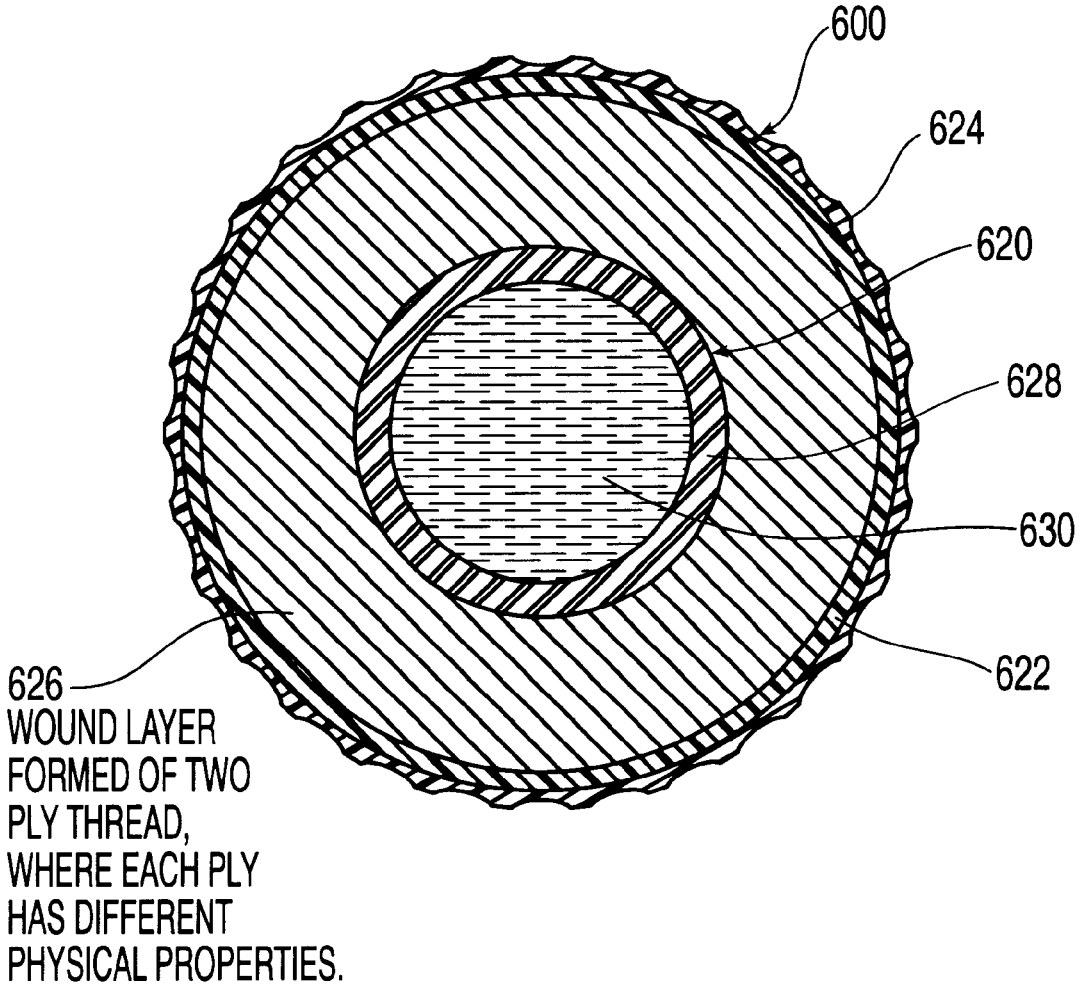
FIG. 8 is a cross-sectional view of an alternative embodiment of a golf ball of the present invention.

Referring to FIG. 8, a wound golf ball 600 comprises a fluid-filled center 620, two cover layers 622 and 624, and at least one wound layer 636 disposed there between. The first cover layer 622 surrounds the wound core and the second cover layer 624 surrounds the first cover layer 622. The fluid-filled center 620 comprises a rubber or thermoplastic envelope 628 with a fluid 630 therein. In another embodiment, a conventional solid center can be used in place of the fluid-filled center. The cover layers 622 and 624 can be formed of materials as discussed above.

While it is apparent that the illustrative embodiments of the invention herein disclosed fulfill the objectives stated above, it will be appreciated that numerous modifications and other embodiments may be devised by those skilled in the art. The wound layer can include at least one layer formed using the inventive thread. The remaining layers can be formed of the inventive thread and/or conventional thread. For example, a plurality of wound layers can be formed where all of the wound layers use the inventive thread. If a three ply thread is used, the third ply can have a maximum elongation that is substantially the same as the two other plies or substantially different from one or both of the other plies. Therefore, it will be understood that the appended claims are intended to cover all such modifications and embodiments which come within the spirit and scope of the present invention.

I claim:

1. A wound golf ball comprising:

a) a center;

b) at least one wound layer surrounding the center to form a wound core, at least one of the wound layers being formed of a thread with at least two plies, the first ply of thread being connected to the second ply of thread, wherein the first ply of thread has different physical properties than the second ply of thread; and c) at least one cover layer surrounding the wound core.

2. The wound golf ball of claim 1, further including a plurality of wound layers wherein the wound layers being formed of a thread with at least two plies, the first ply of thread being connected to the second ply of thread, wherein the first ply of thread has different physical properties than the second ply of thread.

3. The wound golf ball of claim 1, further including two cover layers, the first cover layer surrounding the wound core and the second cover layer surrounding the first cover layer.

4. The wound golf ball of claim 1, wherein the first ply of thread has a first maximum elongation and the second ply of thread has a second maximum elongation, and the first and second maximum elongations are substantially different.

5. The wound golf ball of claim 4, wherein the first ply of thread has a first tensile strength and the second ply of thread has a second tensile strength, and the first and second tensile strengths are substantially different.

6. The wound golf ball of claim 1, wherein the first ply of thread is bonded to the second ply of thread.

7. The wound golf ball of claim 1, wherein the first ply of thread has the same thickness as the second ply of thread.

8. The wound golf ball of claim 1, wherein the first ply of thread has a different thickness than the second ply of thread.

9. The golf ball of claim 1, wherein at least 60% of each ply of thread is formed of two synthetic cis-1,4 polyisoprene rubbers, the first ply of thread having a first ratio of the first cis-1,4 polyisoprene rubber to the second cis-1,4 polyisoprene rubber, the second ply of thread having a second ratio of the first cis-1,4 polyisoprene rubber to the second cis-1,4 polyisoprene rubber, and the first ratio is different from the second ratio by at least about 10%, and the cis-1,4 polyisoprene rubbers each have a cis-1,4 content of at least 90%.

10. The golf ball of claim 9, wherein the first cis-1,4 polyisoprene rubber has a cis-1,4 content of about 90%, and the second cis-1,4 polyisoprene rubber has a cis-1,4 content of about 99%.

11. The wound golf ball of claim 1, wherein the wound layer further includes three bonded plies of thread.

12. The wound golf ball of claim 11, wherein the first ply of thread has a first maximum elongation, the second ply of thread has a second maximum elongation, and the third ply of thread has a third maximum elongation, and the first and third maximum elongations are substantially equal and the first and third maximum elongations are substantially different from the second maximum elongation.

13. The wound golf ball of claim 12, wherein the second ply is disposed between the first and third plies.

14. The wound golf ball of claim 11, wherein the first ply of thread has a first tensile strength and the second ply of thread has a second tensile strength, and the third ply of thread has a third tensile strength, and the first and third tensile strengths are substantially equal and the first and third tensile strengths are substantially different from the second tensile strength.

15. The wound golf ball of claim 11, wherein the first ply of thread has a first tensile strength and the second ply of thread has a second tensile strength, and the third ply of thread has a third tensile strength, and the third tensile strength is substantially equal to the first or second tensile strength.

16. The wound golf ball of claim 11, wherein at least 60% of the third ply of thread is formed of two synthetic cis-1,4 polyisoprene rubbers having a third ratio of the first cis-1,4 polyisoprene rubber to the second cis-1,4 polyisoprene rubber that is the same as at least one of the first or second ratios.

17. The wound golf ball of claim 11, wherein at least 60% the third ply of thread is formed of two synthetic cis-1,4 polyisoprene rubbers having a third ratio of the first cis-1,4 polyisoprene rubber to the second cis-1,4 polyisoprene rubber that is different from the first and second ratios.

18. The wound golf ball of claim 11, wherein the third ply of thread has the same thickness as at least one of the first or second plies of thread.

19. The wound golf ball of claim 11, wherein the third ply of thread has a different thickness than both the first and the second plies of thread.

20. A method of forming a wound golf ball, comprising the steps of:

a) forming a center;

b) forming a sheet of rubber including two plies of material, wherein the first ply of material has different physical properties than the second ply of material;

c) connecting the plies of material together;

d) slitting the sheet of rubber into a plurality of threads;

e) winding the thread about the center to form a core; and f) covering the core with a cover material.

21. The method of claim 20, wherein the step of forming a sheet further includes mixing less than about 40% of a natural rubber with more than about 60% of synthetic cis-1,4 polyisoprene rubber.

22. The method of claim 21, wherein the step of forming a sheet further includes forming the first ply of material separate from the second ply of material, and calendering the two plies of material together.

23. The method of claim 20, wherein the step of connecting the plies further includes curing the sheet of rubber so that the plies of material bond together.

* * * * *